US006905231B2

(12) United States Patent
Dickie

(10) Patent No.: US 6,905,231 B2
(45) Date of Patent: Jun. 14, 2005

(54) NIGHT LIGHT HAVING DIRECTIONALLY ADJUSTABLE LIGHT OUTPUT

(75) Inventor: Robert G. Dickie, Newmarket (CA)

(73) Assignee: Elumina Lighting Technologies Inc., King City (CA)

( * ) Notice: Subject to any disclaimer, the term of this patent is extended or adjusted under 35 U.S.C. 154(b) by 29 days.

(21) Appl. No.: 10/622,543

(22) Filed: Jul. 21, 2003

(65) Prior Publication Data

US 2005/0018426 A1 Jan. 27, 2005

(51) Int. Cl.[7] ..... F21V 21/26

(52) U.S. Cl. ..... 362/271; 362/282; 362/285; 362/290; 362/372

(58) Field of Search ..... 362/271, 282, 362/285, 290, 372, 145, 3, 16, 18, 20, 84, 95, 147, 227, 235, 247, 249, 250, 257, 269, 277, 279, 296, 306, 800

(56) References Cited

U.S. PATENT DOCUMENTS

| | | | | | |
|---|---|---|---|---|---|
| 1,952,783 | A | * | 3/1934 | Tamol | 362/269 |
| 2,539,974 | A | * | 1/1951 | Riddell | 362/199 |
| 3,203,126 | A | | 8/1965 | Eilot | |
| 3,443,083 | A | * | 5/1969 | Curran | 362/226 |
| 3,706,004 | A | | 12/1972 | Schwartz | |
| 3,801,814 | A | * | 4/1974 | Arts | 362/263 |
| 4,344,116 | A | | 8/1982 | Martin | |
| D347,288 | S | * | 5/1994 | Ham | D26/26 |
| 5,523,932 | A | | 6/1996 | Bogdanovs | |
| D425,221 | S | * | 5/2000 | Burns | D26/26 |
| D432,688 | S | * | 10/2000 | Petterson | D26/26 |
| 6,140,934 | A | * | 10/2000 | Lam | 340/815.4 |
| 6,200,001 | B1 | * | 3/2001 | Tin Shun Victor | 362/226 |
| 6,276,813 | B1 | * | 8/2001 | Victor | 362/226 |
| 6,390,647 | B1 | | 5/2002 | Shaefer | |
| 6,527,400 | B2 | | 3/2003 | Dickie et al. | |
| 6,540,376 | B2 | | 4/2003 | Victor | |
| 6,561,677 | B1 | * | 5/2003 | Leen | 362/276 |
| 6,576,852 | B1 | | 6/2003 | Shu | |
| 6,709,126 | B1 | * | 3/2004 | Leen | 362/95 |
| 2002/0141177 | A1 | | 10/2002 | Stekelenburg | |
| 2003/0076680 | A1 | | 4/2003 | Stekelenburg | |
| 2003/0086266 | A1 | | 5/2003 | Leen | |

FOREIGN PATENT DOCUMENTS

| | | |
|---|---|---|
| EP | 0 056 104 A | 7/1982 |
| GB | 1 525 569 A | 9/1978 |
| JP | 07 156711 A | 6/1996 |
| JP | 09 282911 A | 10/1997 |

* cited by examiner

*Primary Examiner*—John Anthony Ward
*Assistant Examiner*—Ismael Negron

(57) ABSTRACT

A directional night light has a front face and a rear face, a source of illumination within the interior of said housing, and an adjustment actuator such as a wheel. At least a portion of the front face is translucent. The light source may be an incandescent bulb, an LED lamp, an LED panel, an electroluminescent panel, an OLED panel, and combinations thereof. The light source is mounted within the housing so as to be rotatable about an axis through an arc of 30° to 150° by actuation of the adjustment actuator, which has a portion extending forwardly beyond the front face. In another embodiment, a directional night light has a bezel mounted front face with a louvered element behind the front face through which light will pass and be directed at an angle away from the front face.

16 Claims, 7 Drawing Sheets

NIGHT LIGHT HAVING DIRECTIONALLY ADJUSTABLE LIGHT OUTPUT

FIELD OF THE INVENTION

This invention relates to night lights, and particularly to night lights that have directional light output whereby a particular region in the surroundings where the night light is mounted may be illuminated while leaving other regions in the surroundings where the night light is mounted without illumination.

1. Background of the Invention

Night lights have been known for many years, and many known night lights have had a modicum of directionality of the light emanating therefrom. Typically, such night lights comprise a small incandescent bulb having power output of perhaps 2 or 3 watts; and being equipped with a movable hood or shade. Incandescent bulbs are omnidirectional, and thus if it is desired that light from such a bulb shall not be directed in a particular direction, it is necessary to place a physical barrier against light being radiated from the bulb in that direction.

More recently, the use of other illumination sources than incandescent bulbs in night lights is known. Particularly, the use of electroluminescent panels is known; and such panels may comprise LEDs and OLEDs. Other cool operating sources of illumination may be such as LED lamps, which have very high efficiency and therefore little or no heat output. However, typically light output from an LED lamp is not omnidirectional, but rather light may be directed as a consequence of the lens and other features of the construction of the LED lamp through an arc of as little as 30° to perhaps as much as 150°.

The present inventor is quite unexpectedly discovered that contrary to prior art devices, noted below, which control light in a rotational matter but do not permit light fall downwardly so as to be almost directly below the night light, a variety of structures may be employed which do permit illumination in the immediate vicinity of the night light when mounted. That desirable criterion may be accomplished such as by the use of a rotational reflector, the use of a rotational lens, or the use of a rotational light source subassembly within the housing and structure of the night light, all as discussed hereafter.

Moreover, the present inventor has provided night light assemblies which, if they employ incandescent bulbs as their source of illumination, will run cool as a consequence of convective air flow through the structure. Still further, such air flow is convoluted or serpentine in nature, whereby the incandescent bulb is protected from the entry of liquids and contact thereof with the incandescent bulb, while permitting convective air flow and cooling of the bulb.

2. Description of the Prior Art

The use of electroluminescent or other solid state lighting sources is demonstrated, for example, in Dickie et al U.S. Pat. No. 6,527,400.

Directional or swivel night lights are known from a series of related United States Patents all issued to Au Yeung Tin Shun Victor. They include U.S. Pat. No. 6,200,001; 6,276,813; and 6,540,376. Each of those patents has the same disclosure, and each teaches a night light which plugs directly into an electrical outlet and has a rotatable housing which swivels so as to direct light in a desired direction. The light source is an incandescent bulb. The front face of the night light is set at an angle to the horizontal axis of the night light when plugged in, whereby a swivel action of the bezel mounted front lens housing results in directional light output. However, due to the physical limitations of the front lens housing, the directionality of the light appears to be limited to about ±30° from the horizontal axis, in any direction.

U.S. Pat. No. 5,523,932 issued to Bogdanovs teaches a lighting fixture which comprises an adjustable reflector which can be rotated about the horizontal axis, and locked in any position, so that light from an incandescent bulb can be directed in a direction radially outwardly from the horizontal axis.

SUMMARY OF THE INVENTION

In accordance with one aspect of the present invention, there is provided a night light which comprises a housing having a front face and a rear face, an electrically powered source of illumination within the interior of the housing and located between the front and rear faces, and an adjustment actuator.

The rear face is substantially planar, and has electrical blades which extend rearwardly therefrom for placement into an electrical socket.

At least a portion of the front face is translucent.

The source of illumination may be chosen from the group which consists of an incandescent bulb together with the reflector whereby light from the incandescent bulb is directed away from the reflector, at least one LED lamp, an LED panel, an electroluminescent panel, an OLED panel, and combinations thereof.

The source of illumination is mounted within the housing so that it is rotatable about an axis of rotation through an arc of 30° to 150° by actuation of the adjustment actuator which is mounted within the housing on the axis of rotation of the source of illumination, with a portion of the adjustment actuator extending forwardly beyond the front face of the housing.

In some instances, the source of illumination may be an incandescent lamp; and in such instances, the reflector surrounds the lamp to an extent of at least 180°.

If so, the incandescent lamp is elongated and is horizontally mounted, so that rotation of the source of illumination—the incandescent lamp together with the reflector, or at least of the reflector—sweeps a vertically directed arc.

In another variation, the source of illumination may be at least one LED lamp having a forwardly directed beam of light, so that rotation thereof sweeps a vertically directed arc.

Otherwise, the source of illumination may also be an electroluminescent panel, an LED panel, or an OLED panel, each having a forward the directed illumination and which is horizontally mounted, so that rotation thereof sweeps a vertically directed arc.

In some embodiments of the present invention, the entire front face may be translucent.

Typically, the source of illumination is mounted near the bottom of the housing, and is structured so that rotation thereof through an arc which is in the range of 30° to 60°, will be such that light from the source of illumination is directed generally downwardly.

The adjustment actuator may be such as an adjustment wheel, and adjustment lever, or an an adjustment slider.

When the adjustment actuator is an adjustment wheel, the portion of the adjustment wheel which extends beyond the front face of the night light typically has a peripheral arc which is in the range of 90° to 180°.

The housing may be such that it has bottom and top surfaces that have at least one vent opening in each, so as to permit convection air flow through the housing.

If so, and particularly when the source of illumination is an incandescent bulb, then the interior of the housing may have discrete bottom, front, and top chambers, and has openings between the bottom and the top chambers, respectively, to the front chamber. Thus, convection air flow through the housing is through the bottom vent opening, through the bottom chamber, through the front chamber, through the top chamber, and from the top vent opening.

Another embodiment of the present invention provides for a night light which comprises a housing having a front face and a rear face, an electrically powered source of illumination within the interior of the housing located between the front and rear faces, and a louvered element which is located behind the front face.

The source of illumination, in this case, is an incandescent bulb.

The rear face is substantially planar and has electrical blades which extend rearwardly therefrom for placement into an electrical socket.

The front face is substantially planar and is translucent, and is subtended by a rearwardly and outwardly sloping side wall, so that the front face and the side wall together form a front chamber within which the source of illumination is mounted.

A rear chamber housing is formed forwardly of rear face and behind a mounting face which defines the rearmost extent of the front chamber. The source of illumination is mounted on the mounting face.

The night light has a substantially circular configuration, in this case, and the rearmost ends of the rearwardly and outwardly sloping side wall are rotatably mounted to the exterior of the rear chamber housing.

The louvered element is mounted so as to be rotatable with the front face and the circularly configured rearwardly and outwardly sloping sidewall, so that light emanating from the source of illumination and passing the louvered element and through the translucent face is directed away from the front face at an angle thereto.

The louvered element typically comprises a plurality of louvers which are in fixed relationship one to another.

The louvered element may also comprise a plurality of louvers that are integrally molded together with the front face.

Alternatively, the louvered element may comprise a plurality of louvers which are molded from an opaque or reflective material, and which are mounted behind and integrally with the front face so as to be rotatable therewith.

Typically, the rear chamber housing has discrete bottom and top chambers, and has vent openings between the bottom and top chambers and the front chamber.

The rear chamber housing also has bottom and top surface regions and at least one vent opening in each of the bottom and top surface regions so as to permit convection air flow through the night light from the bottom vent opening, through the bottom chamber, through the front chamber, through the top chamber, and from the top vent opening.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS:

The novel features which are believed to be characteristic of the present invention, as to its structure, organization, use and method of operation, together with further objectives and advantages thereof, will be better understood from the following discussion.

The embodiments of FIGS. 1 to 13 provide various night lights which will allow for an aimable or directional light emission from a night light placed in a wall-mounted electrical receptacle, which is a typical manner in which night lights are employed. Quite often the night light is placed in a hallway or the like, by being inserted into a electric receptacle which is fairly near the floor, such as about 30 or 40 cm above the floor. Such night lights are intended to provide low level illumination along the passageway for easy traverse thereof at nighttime. Other night lights might be placed in a wall-mounted receptacle above such as a kitchen or bathroom counter, once again so as to provide low level illumination in order that a person might locate the counter, something on the counter, or a sink or basin mounted in the counter. In all events, it is usual that there may be a desire for light emanating from the night light structure to be directed downwardly or in some other direction other than upwardly, so as not to shine into the eyes of someone traversing the passageway or entering the kitchen or bathroom during nighttime.

However, prior art night lights do not permit the nearly vertically downward directionality of light emanating from the night light structure, as does the present invention. Also, the present invention can take advantage of cool operating solid state sources of illumination; while at the same time providing for convection cooling of night light structures that may employ incandescent bulbs as the source of illumination. Specific night light structures in keeping with the present invention provide for convection cooling in such a manner that the possible contact of a liquid with the incandescent bulb is precluded.

Turning first to FIGS. 1 to 6, a first embodiment of a night light is shown that employs an incandescent bulb as the source of illumination, but which can be adjusted so as to provide downwardly directed illumination so that the region very near the wall where the night light is mounted, below the night light, can be illuminated. The embodiment which is specifically illustrated in FIGS. 1 to 6 also provides for convection cooling of an incandescent light bulb and of the night light structure per se, so as to thereby eliminate or substantially preclude risk of injury by contact with a hot night light structure.

Figure 4:
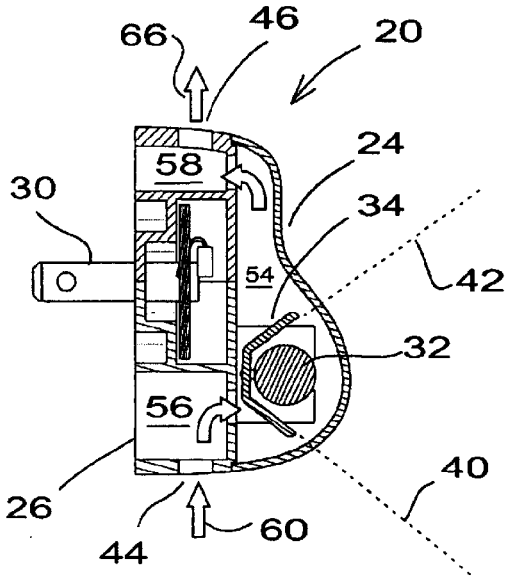
FIG. 4 is a cross-sectional view of a specific species of the embodiment of FIG. 1.
Figure 5:
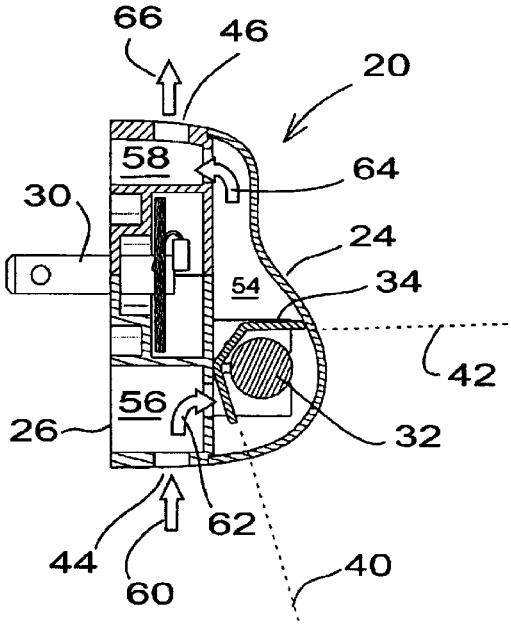
FIG. 5 is a cross-sectional view similar to FIG. 4, with a reflector having been rotated downwardly.
Figure 6:
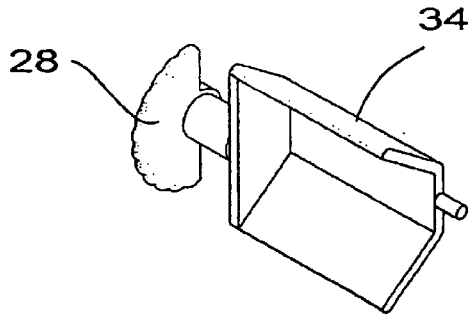
FIG. 6 is a perspective view of a reflector and an adjustment wheel associated therewith.
Figure 7:
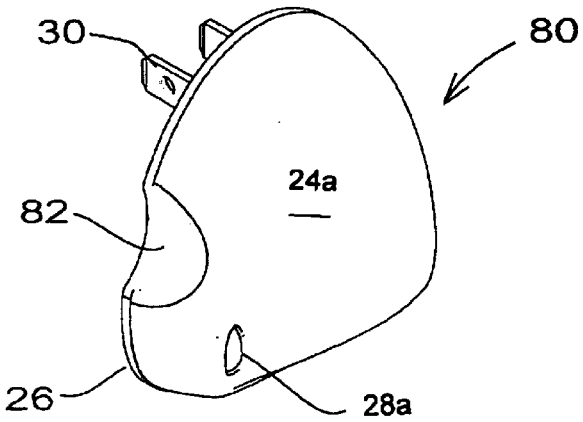
FIG. 7 is a perspective front view of a second embodiment of night light in keeping with the present invention.
Figure 8:
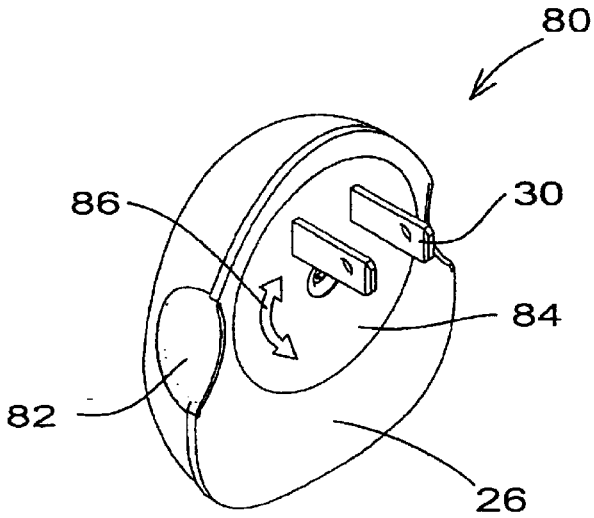
FIG. 8 is a perspective rear view of the embodiment of FIG. 7.

A night light 20, or features thereof, is shown in FIGS. 1 to 5; and a specific feature of the night light 20 is shown in FIG. 6. The night light 20 comprises a housing 22 which has a front face 24 and a rear face 26. An adjustment actuator 28—which typically is an adjustment wheel—projects outwardly from the front face 24 at one side of the housing which is defined by the front and rear faces 24, 26.

The rear face 26 has a pair of electrical blades 30 projecting therefrom, so that they may be placed into an electrical socket for activation of the night light 20. Within the interior of the night light 20 there is an incandescent bulb 32 located, and it is typically mounted horizontally. The incandescent bulb 32 is surrounded by a reflector 34 at least to an extent of 180°, so that omnidirectional light emanating from the light bulb 32 will be redirected forwardly from the reflector 34.

Figure 1:
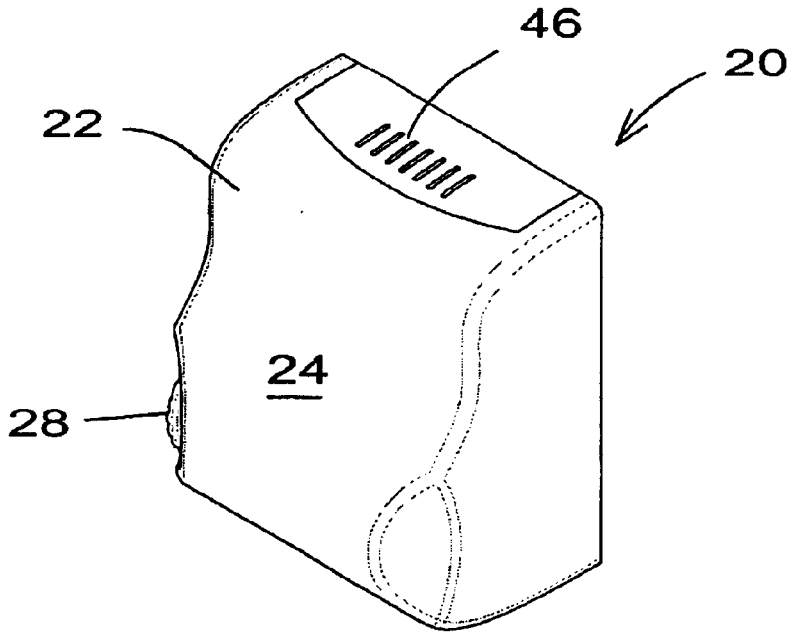
FIG. 1 is a perspective front view of a first embodiment of night light in keeping with the present invention.
Figure 2:
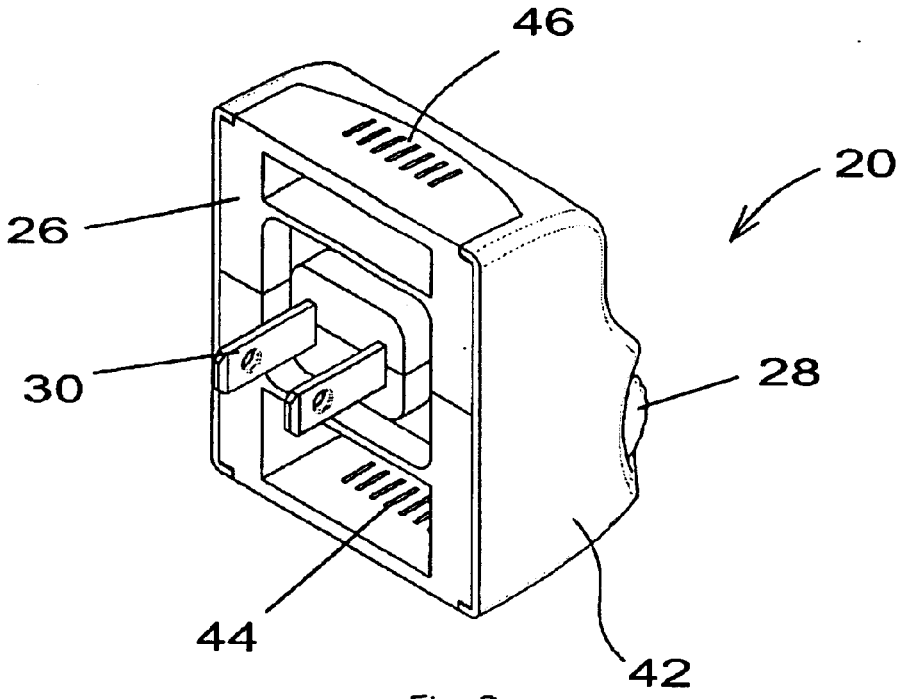
FIG. 2 is a perspective rear view of the embodiment of FIG. 1.
Figure 3:
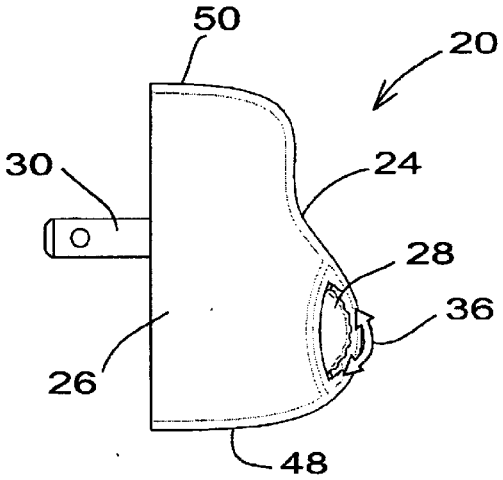
FIG. 3 is a side view of the embodiment of FIG. 1.

As seen in FIG. 6, the reflector 34 and the adjustment actuator 28 are mounted one to the other in such a manner that movement of the adjustment actuator 28, in the manner shown by arrow 36 in FIG. 3, will cause rotation of the reflector 34 about a horizontal axis, as can be easily seen by reference to FIGS. 4 and 5.

It will also be understood to those skilled in the art, that while typically the adjustment actuator 28 is a wheel, as illustrated, it could also be such as a lever or slider which is mounted on the axis of rotation of the source of illumination so as to serve the same purpose as described herein.

It will also be seen from FIGS. 4 and 5 that rotation of the reflector 34 will cause the light which emanates from the incandescent bulb 32 to sweep through a vertically directed arc, as can be seen by comparing the lines 40, 42 which define the limits of the beam of light being directed by the reflector 34, as those lines are depicted in FIGS. 4 and 5, respectively. It will also be seen from FIG. 5 that the line 40 suggests that the region in the area immediately below the mounted night light 20 will be illuminated; and thus, for example, if the night light 20 is mounted close to a floor than the floor in the region close to the wall where the night light is mounted will be illuminated.

Typically, at least a portion of the front face 24 is translucent. However, the entire front face 24, or for that matter the entire structure of the front face 24 and in the sidewalls 43 can be molded from a translucent or semi-translucent plastics material. In any event, it will be understood that at least that portion of the front face 24 which is in the lower region thereof will be translucent so that light emanating from the source of illumination will be seen at the exterior of the night light 20. Typically, the arc that is swept by rotation of the reflector 34 through actuation of the adjustment wheel 28, will be in the range of 30° to 60°.

It will also be noted that the portion of the adjustment wheel 28 which extends beyond the front face 24 of the night light 20 will typically have a peripheral arc that is visible from the exterior of the night light 20, and which is in the range of from 90° to 180°.

It will also be understood that the source of illumination may not necessarily be an incandescent bulb 32, but it may be a solid state source of illumination such as one or more LED lamps, an LED panel, an OLED panel, other electroluminescent panels, and the like. Such alternative sources of illumination are discussed in greater detail hereafter, in association with the embodiment of night light in keeping with the present invention as it is shown in FIGS. 7 to 13.

However, a typical configuration of night light 20 is one which does employ an incandescent bulb; and if so, there is a necessity for the night light to run cool, and therefore there is a necessity to provide for convection cooling of the incandescent bulb 32. Accordingly, vent openings 44 and 46 may be provided in each of the bottom and top surfaces 48 and 50, respectively.

It will be seen from FIGS. 4 and 5 that the interior of the housing 22 has at least three chambers formed therein. They include a front chamber 54, a bottom chamber 56, and a top chamber 58. It will be seen by following arrows 60, 62, 64, and 66, that convection air flow through the night light 20 follows the route through the least one bottom vent opening 44, through chamber 56 into chamber 54, from chamber 54 into chamber 58, and from chamber 58 through the at least one top vent opening 46. It will also be understood that this convoluted or serpentine flow of air precludes the likelihood of inadvertent liquid contact with the incandescent bulb 32. Such a circumstance might occur, for example, in the instance where the night light is mounted above a counter in a kitchen or bathroom, and in the vicinity near a sink or basin, respectively.

Turning now to FIGS. 7 to 13, a further embodiment of a night light in keeping with the present invention is shown at 80. Because a number of the elements or features of the night light 80 are similar to or identical with the same elements of the night light 20, the same reference numerals are employed.

A pair of indents 82 are provided, which assist in the placing and removal of the night light 80 into and from an electrical socket. The electrical blades 30 may be mounted on a rotatable plate 84, so that the night light 80 can be rotated through 180°—that is, 90° clockwise and counter-clockwise from the vertical—as shown by arrow 86. It will be obvious that such a mounting arrangement can be provided for any night light in keeping with present invention, particularly any of those that are illustrated in any of FIGS. 1 to 13.

It will also be noted that there is a lower portion of the front face 24*a* shown at 90, and at least that portion 90 if not the entirety of the front face 24*a* of the night light 80 is translucent. In any event, it will be seen that differing sources of illumination are illustrated than have been previously described. For example, in each of FIGS. 9 and 10, at least one LED lamp 92 is shown, having a forwardly directed beam of light which is such as defined by lines 40*a*, 42*a*. Typically, three such LED lamps 92 are employed. It will be easily understood that the mounting of the source of illumination 92, an LED lamp or lamps, is associated with the adjustment wheel 28*a* so that actuation of the adjustment wheel 28*a* will cause rotation of the LED lamp or lamps 92 so that the beam defined by lines 40*a*, 42*a* sweeps through an arc of at least 30°. Indeed, it can be understood that the arc of the beam could be as much as 150°, but typically it would be less than 90°.

Figure 9:
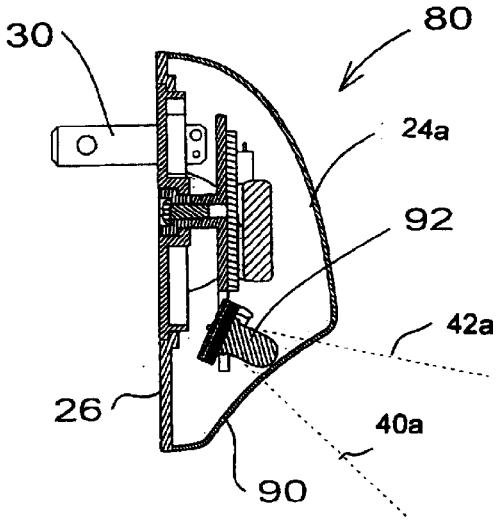
FIG. 9 is a cross-sectional view of a specific species of the embodiment of FIG. 7.
Figure 10:
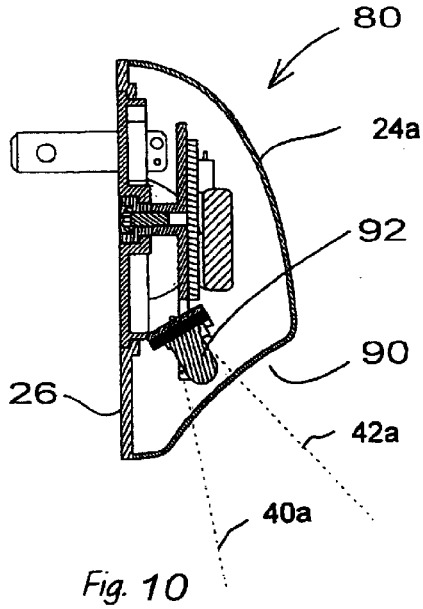
FIG. 10 is a cross-sectional view similar to FIG. 9, with the source of illumination having been rotated downwardly.
Figure 11:
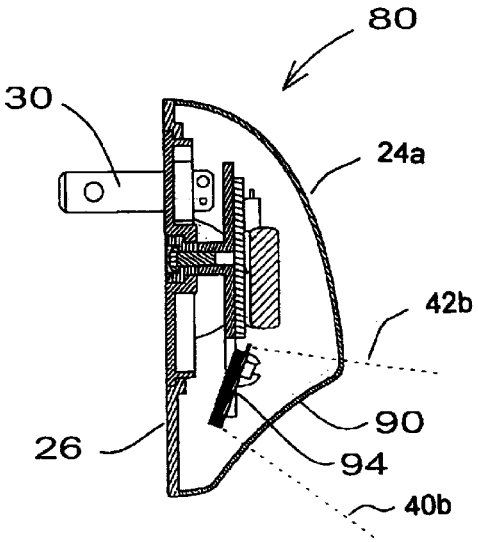
FIG. 11 is a cross-sectional view of another specific species of the embodiment of FIG. 7.
Figure 12:
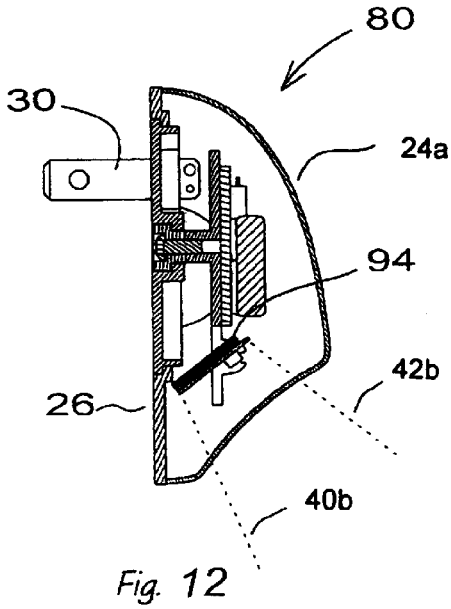
FIG. 12 is a cross-sectional view similar to FIG. 11, with the source of illumination having been rotated downwardly.
Figure 13:
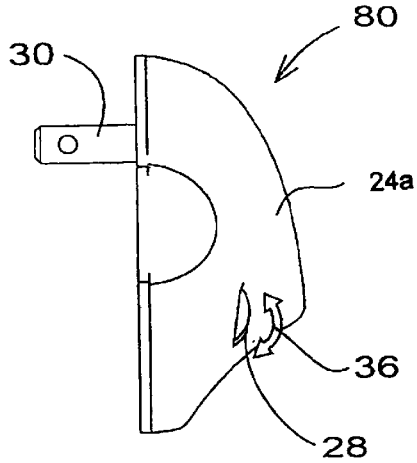
FIG. 13 is a side view of the embodiment of FIG. 7.
Figure 14:
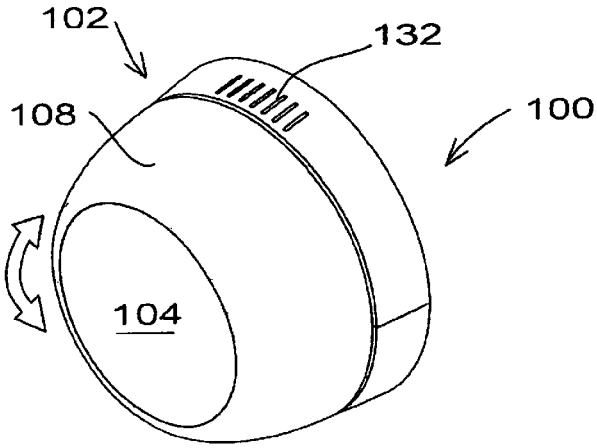
FIG. 14 is a perspective front view of a third embodiment of night light in keeping with the present invention.
Figure 15:
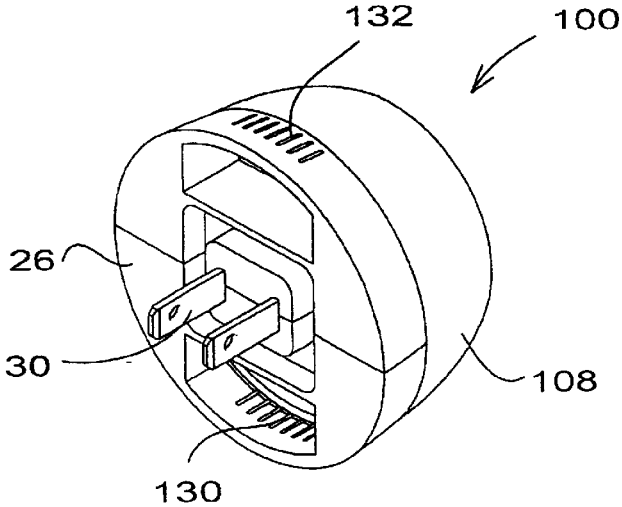
FIG. 15 is a perspective rear view of the embodiment of FIG. 14.
Figure 16:
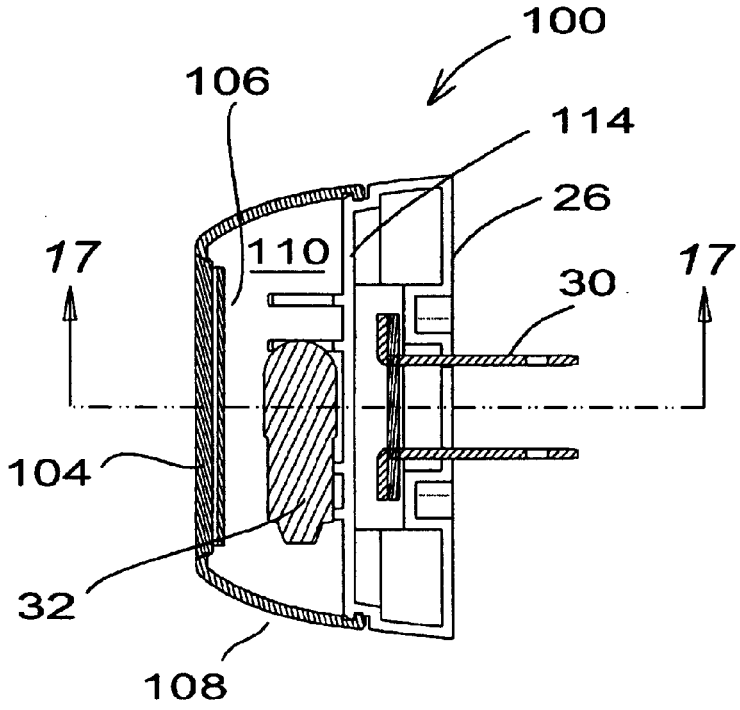
FIG. 16 is a cross-sectional view of the embodiment of FIG. 14.

FIGS. 11 and 12 differ from FIGS. 9 and 10 in that the source of illumination 94 is a panel which might be an electroluminescent panel, and more particularly an LED panel or an OLED panel, any of which have a forwardly directed illumination as indicated by the lines 40*b*, 42*b*. Once again, the panel source of illumination 94 is horizontally mounted so that rotation thereof by actuation of the adjustment wheel 28*a* will sweep a vertically directed arc which is typically in the range of 30° to 60°, but which may be as much as 150°.

A differing embodiment then has been described above is shown in FIGS. 14 to 19. Here, a directional night light is shown that has a substantially circular configuration when viewed from the front, and where the front face and the side wall which subtends the front face are bezel mounted so that light emanating from the front face may be directed in a desired direction, as will now be described.

The night light 100 once again comprises a rear face 26 from which electrical blades 30 project for placement into an electrical socket. In this case, however, the night light 100 comprises a housing 102 which has the rear face 26, a front face 104, an incandescent bulb 32, and a louvered element 106 which is located behind the front face 104. The front face 104 is substantially planar and translucent. It will be noted that the front face 104 is subtended by a rearwardly and outwardly sloping side wall 108. It will be understood from FIGS. 16 and 17 that the front face 104 and the side wall 108 together form a front chamber 110 within which the source of illumination 32 is mounted.

There is a mounting face 114 which is formed forwardly of the rear face 26 and which defines a rear chamber that includes stationary discrete bottom chambers 116 and 118, respectively, together with other unannotated chamber or chambers which accommodate the electrical circuitry, the electrical blades 30, etc., for the night light 100. It will be seen that the lamp 32 is mounted on the mounting face 114.

Figure 17:
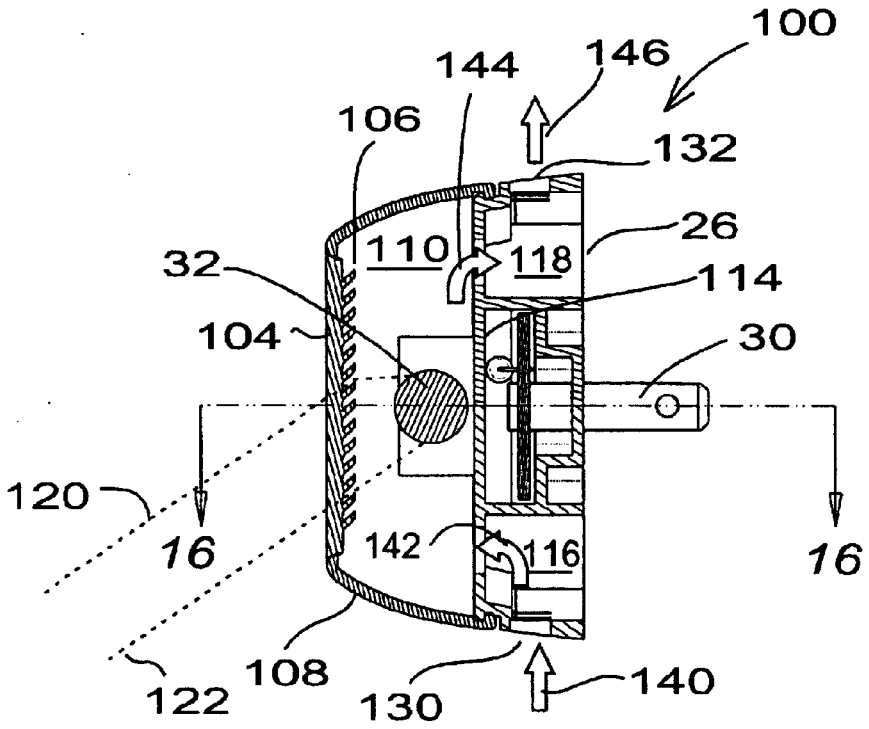
FIG. 17 is a cross-sectional view similar to FIG. 16, with the source of illumination having been rotated downwardly.
Figure 18:
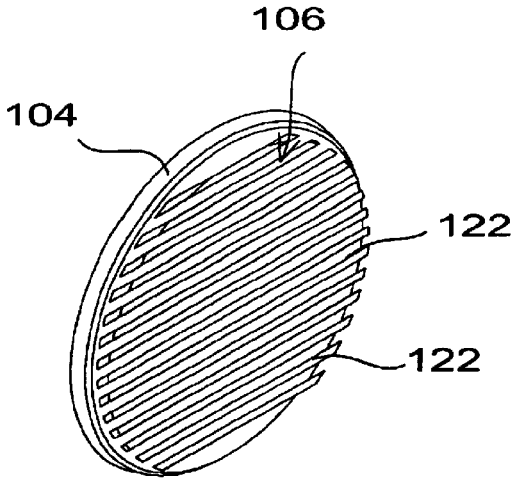
FIG. 18 is a perspective view of the front face of the embodiment of FIG. 14.
Figure 19:
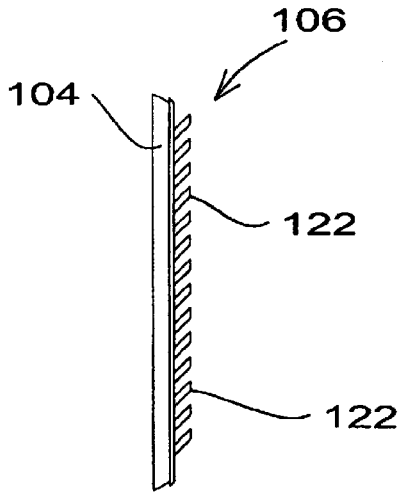
FIG. 19 is a side view of the front face shown in FIG. 18.

The louvered element 106 is mounted so as to be rotatable with the front face 104 and the circularly configured rearwardly sloping side wall 108, so that light emanating from the source of illumination 32 passes through the louvered element 106 and front face 104 and is directed away from the front face 104 at an angle thereto, as illustrated by lines 120, 122 in FIG. 17.

Typically, the louvered element 106 comprises a plurality of discrete louvers 123 that are in fixed relationship one to another. The louvered element 106 may be integrally molded together with the front face 104. Alternatively, the louvered element 106 may comprise a plurality of discrete louvers 123 that are molded from an opaque or reflective material, and which are mounted behind and integrally with the front face 104 so as to be rotatable therewith.

It has been noted that there are discrete chambers 116 and 118 formed within the rear chamber housing. It will also be seen in each of FIGS. 14, 15, and 17, that vent openings 130 and 132 may be formed in the bottom and top surface regions of the rear chamber, respectively. Thus, it will be understood that convection cooling of the interior of the night light 100 will be effected by airflow through the bottom vent opening 130, through the bottom chamber 116 to the front chamber 110, from the front chamber 110 to top chamber 118, and then from the top vent opening 132, all as seen by arrows 140, 142, 144, 146.

There have been described several embodiments of directional night lights, whereby light emanating from the night light may be directed in any specific and desired direction. Typically, such direction is downwardly, so that light from the night light does not shine upwardly into the eyes of an observer. Various sources of illumination have been discussed; and where the source of illumination is an incandescent bulb, provision is made for convection cooling whereby the flow of cooling air is serpentine. Moreover, the mounting of the incandescent bulb and its relation to discrete chambers through which convection cooling air will flow is such that inadvertent contact by a liquid to the incandescent bulb is precluded.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. A night light comprising:

a housing having front face and a substantially planar rear faces;

an electrically powered source of illumination disposed within the interior of said housing and located between said front and rear faces;

an adjustment actuator which is mounted within said housing on an axis of rotation, with a portion of said adjustment actuator extending forwardly beyond said front face;

electrical blades extending rearwardly from the rear face for placement into an electrical socket;

at least a portion of said front face being translucent;

said source of illumination being chosen from the group consisting of an incandescent bulb a reflector for directing light generally forward, at least one LED lamp, an LED panel, and an electroluminescent panel, and an OLED panel; and wherein said source of illumination is mounted within said housing so as to be rotatable about the axis of rotation through an arc of 30° to 150° by actuation of said adjustment actuator.

2. The night light of claim 1, wherein said source of illumination is at least one LED lamp having a forwardly directed beam of light, mounted so that rotation thereof sweeps a vertically directed arc.

3. The night light of claim 1, wherein said source of illumination is one of the group consisting of an electroluminescent panel, an LED panel, and an OLED panel, having a forwardly directed illumination horizontally mounted so that rotation thereof sweeps a vertically directed arc.

4. The night light of claim 1, wherein all of said front face is translucent.

5. The night light of claim 1, wherein said source of illumination is mounted near the bottom of said housing, wherein said arc that is swept by rotation thereof is in the range of 30° to 601, and wherein the light from said source of illumination is directed generally downwardly.

6. The night light of claim 1, wherein said adjustment actuator is chosen from the group consisting of an adjustment wheel, an adjustment lever, and an adjustment slider.

7. The night light of claim 1, wherein the portion of said adjustment wheel that extends beyond said front face has a peripheral arc in the range of 90° to 180°.

8. The night light of claim 1, wherein said source of illumination is an incandescent lamp; and said reflector surrounds said lamp to an extent of at least 180°.

9. The night light of claim 8, wherein said incandescent lamp is elongated and is horizontally mounted, so that rotation of said source of illumination sweeps a vertically directed arc.

10. The night light of claim 8, wherein said housing has bottom and top surfaces, and said least one vent opening is formed in each said bottom and top surfaces so as to permit convection air flow through said housing.

11. The night light of claim 10, wherein the interior of said housing has discrete bottom, front, and top chambers, and has openings between said bottom and top chambers and said front chamber, whereby convection flow through said housing is through said bottom vent opening, through said bottom chamber, through said front chamber, through said top chamber, and from said top vent opening.

12. A night light comprising a housing having a front face and a rear face, an electrically powered source of illumination within the interior of said housing located between said front and rear faces, and a louvered element located behind said front face;

wherein said electrically powered source of illumination is an incandescent bulb;

wherein said rear face is substantially planar and has electrical blades extending rearwardly therefrom for placement into an electrical socket;

wherein said front face is substantially planar and is translucent, and is subtended by a rearwardly and outwardly sloping side wall, so that said front face and said side wall together form a front chamber within which said source of illumination is mounted;

wherein a rear chamber housing is formed forwardly of said rear face and behind a mounting face which defines the rearmost extent of said front chamber, and wherein said source of illumination is mounted on said mounting face;

wherein said night light has a substantially circular configuration, and wherein the rearmost ends of said rearwardly and outwardly sloping side wall are rotatably mounted to the exterior of said rear chamber housing; and wherein said louvered element is mounted so as to be rotatable with said front face and said circularly configured rearwardly and outwardly sloping side wall so that light emanating from said source of illumination and passing said louvered element and through said translucent front face is directed away from said front face at an angle thereto.

13. The night light of claim 12, wherein said louvered element comprises a plurality of louvers in fixed relationship one-to another.

14. The night light of claim 12, wherein said louvered element comprises a plurality of louvers that are integrally molded together with said front face.

15. The night light of claim 12, wherein said louvered element comprises a plurality of louvers which are molded from an opaque or reflective material and are mounted behind an integrally with said front face so as to be rotatable therewith.

16. The night light of claim 12, wherein said rear chamber housing has discrete bottom and top chambers, and has vent openings between said bottom and top chambers and said front chamber; and wherein said rear chamber housing has bottom and top surface regions and at least one vent opening that is formed in each of said bottom and top surface regions so as to permit convection air flow through said night light through said bottom vent opening, through said bottom chamber, through said front chamber, through said top chamber, and from said top vent opening.

* * * * *